US009153215B2

(12) United States Patent
Morrison et al.

(10) Patent No.: US 9,153,215 B2
(45) Date of Patent: Oct. 6, 2015

(54) MOUTHPIECE LIGATURE FOR WOODWIND INSTRUMENTS

(71) Applicant: Final Frontier Technology, LLC, Seattle, WA (US)

(72) Inventors: John Morrison, Seattle, WA (US); William Furman O'Dell, Evergreen, CO (US); Christopher H. Converse, Boulder, CO (US)

(73) Assignee: Final Frontier Technology, LLC, Seattle, WA (US)

( * ) Notice: Subject to any disclaimer, the term of this patent is extended or adjusted under 35 U.S.C. 154(b) by 0 days.

(21) Appl. No.: 14/383,669

(22) PCT Filed: Jan. 30, 2014

(86) PCT No.: PCT/US2014/013750
§ 371 (c)(1),
(2) Date: Sep. 8, 2014

(87) PCT Pub. No.: WO2014/120870
PCT Pub. Date: Aug. 7, 2014

(65) Prior Publication Data

US 2015/0013522 A1 Jan. 15, 2015

Related U.S. Application Data

(60) Provisional application No. 61/819,343, filed on May 3, 2013, provisional application No. 61/759,168, filed on Jan. 31, 2013.

(51) Int. Cl.
*G10D 9/02* (2006.01)

(52) U.S. Cl.
CPC . *G10D 9/023* (2013.01); *G10D 9/02* (2013.01)

(58) Field of Classification Search
CPC ..... G10D 9/023; G10D 9/02
USPC ..... 84/383 A, 383 R
See application file for complete search history.

(56) References Cited

U.S. PATENT DOCUMENTS

| | | | | |
|---|---|---|---|---|
| 3,521,517 | A * | 7/1970 | Sato | 84/383 R |
| 4,056,997 | A | 11/1977 | Rovner | |
| 4,991,483 | A | 2/1991 | Petit | |
| 5,018,425 | A | 5/1991 | Rovner | |
| 5,998,715 | A | 12/1999 | Rovner | |
| 6,289,558 | B1 | 9/2001 | Hammerslag | |
| 7,591,050 | B2 | 9/2009 | Hammerslag | |
| 7,626,105 | B2 | 12/2009 | Rovner | |
| 7,737,350 | B2 * | 6/2010 | Wanne | 84/383 A |
| 7,863,509 | B2 | 1/2011 | Rovner | |

(Continued)

OTHER PUBLICATIONS

PCT Application No. PCT/US2014/013750, Search Report and Written Opinion dated May 19, 2014, 7 pages.

*Primary Examiner* — Jianchun Qin
(74) *Attorney, Agent, or Firm* — K&L Gates LLP

(57) ABSTRACT

Disclosed herein is a ligature providing secure contact between the reed and mouthpiece while at the same time allowing for faster adjustment of the reed location and contact point with respect to the mouthpiece cavity such that longer or shorter reed vibrations can be easily obtained if desired. The improved ligature is adaptable to fit a wide range of woodwind instrument mouthpieces. In addition, the ligature has limited points of contact with the mouthpiece, so as to eliminate or reduce abrasions to the mouthpiece assembly associated with the application of the ligature.

29 Claims, 16 Drawing Sheets

(56) References Cited

U.S. PATENT DOCUMENTS

| | | | | |
|---|---|---|---|---|
| 7,939,738 | B2 | 5/2011 | Rovner | |
| 7,950,112 | B2 | 5/2011 | Hammerslag et al. | |
| 7,954,204 | B2 | 6/2011 | Hammerslag et al. | |
| 7,982,112 | B2 | 7/2011 | Rovner | |
| 7,992,261 | B2 | 8/2011 | Hammerslag et al. | |
| 8,091,182 | B2 | 1/2012 | Hammerslag et al. | |
| 8,217,248 | B1 * | 7/2012 | Feliciano | 84/383 R |
| 8,277,401 | B2 | 10/2012 | Hammerslag et al. | |
| 8,381,362 | B2 | 2/2013 | Hammerslag et al. | |
| 8,424,168 | B2 | 4/2013 | Soderberg et al. | |
| 8,468,657 | B2 * | 6/2013 | Soderberg et al. | 24/68 SK |
| 8,516,662 | B2 | 8/2013 | Goodman et al. | |
| 8,713,820 | B2 | 5/2014 | Kerns et al. | |
| 2005/0061136 | A1 | 3/2005 | Rovner | |
| 2005/0061137 | A1 | 3/2005 | Rovner | |
| 2005/0072623 | A1 | 4/2005 | Rovner | |
| 2005/0172463 | A1 | 8/2005 | Rolla | |
| 2009/0217798 | A1 | 9/2009 | Rovner | |
| 2009/0217799 | A1 | 9/2009 | Rovner | |
| 2009/0217800 | A1 | 9/2009 | Rovner | |
| 2010/0043621 | A1 | 2/2010 | Rovner | |
| 2010/0299959 | A1 | 12/2010 | Hammerslag et al. | |
| 2011/0162508 | A1 | 7/2011 | Rovner | |
| 2011/0225843 | A1 | 9/2011 | Kerns et al. | |
| 2011/0266384 | A1 | 11/2011 | Goodman et al. | |
| 2012/0000091 | A1 | 1/2012 | Cotterman et al. | |
| 2012/0004587 | A1 | 1/2012 | Nickel et al. | |
| 2012/0152083 | A1 | 6/2012 | Rovner | |

* cited by examiner

MOUTHPIECE LIGATURE FOR WOODWIND INSTRUMENTS

CROSS-REFERENCE TO RELATED APPLICATIONS

This application is a national phase application of International Patent Application No. PCT/US2014/013750 filed on Jan. 30, 2014 which claims the benefit of U.S. Provisional Application No. 61/759,168, filed Jan. 31, 2013, and U.S. Provisional Application No. 61/819,343, filed May 3, 2013, the disclosures of which are incorporated herein by reference in its entirety.

FIELD OF THE INVENTION

Disclosed herein are ligatures relating generally to woodwind instruments and more specifically to mouthpiece assemblies wherein a reed or other vibrating member must be securely held to a mouthpiece.

BACKGROUND OF THE INVENTION

Woodwind musical instruments utilize a tubular body to define a column of air. Sound waves are produced within the column of air and can be modulated by changing the acoustic characteristics of the column. A mouthpiece is connected to the tubular body and contains a cavity in communication with the interior of the tubular body. Woodwind musical instruments utilize the vibration of a reed that covers the cavity of the mouthpiece to generate tones through the oscillation of the reed.

The reed is held in place by an adjustable clamp or ligature surrounding both the mouthpiece and the reed. Traditionally, the ligature is a metal band extending the circumference of the mouthpiece body. Tightening mechanisms such as screws are used to tighten the ligature around the reed and the mouthpiece body to securely hold the reed in contact with the mouthpiece body. The contact created by the ligature between the reed and the mouthpiece can play a major role in the tonal qualities of the instrument. The more tightly the reed is held in place, the more dampened the sound.

The traditional metal ligatures that utilize screws as tightening mechanisms are burdensome to adjust and can require several attempts to tighten and loosen the ligature to ensure proper contact between the reed and the mouthpiece. Additionally, traditional metal ligatures are individually sized for each mouthpiece requiring the use of multiple different ligatures for each varying mouthpiece. For example, with traditional metal band ligatures a person would need three separate ligatures to fit an alto, soprano and baritone mouthpiece. Finally, over tightening of traditional ligatures can lead to scratching of the mouthpiece.

SUMMARY OF THE INVENTION

An improved ligature provides secure contact between the reed and mouthpiece while at the same time allowing for faster adjustment of the reed location and contact point with respect to the mouthpiece cavity such that longer or shorter reed vibrations can be easily obtained if desired. The ligature may be adaptable to fit a wide range of woodwind instrument mouthpieces. In addition, the ligature has limited points of contact with the mouthpiece assembly, so as to eliminate or reduce abrasions to the mouthpiece assembly associated with the application of the ligature.

In one general aspect, some example embodiments described by the present disclosure are directed to a ligature for an instrument having a reed and a mouthpiece. According to these various examples, the ligature has a housing with a cradle portion which is shaped to engage the reed. The ligature also includes a spool that is rotatably coupled to the housing and includes a tightening mechanism. The ligature further includes a flexible lace that is coupled to the spool and extends in a loop from the housing. The loop is sized such that it extends around the circumference of the mouthpiece. The ligature also includes a locking mechanism that is coupled to the housing and engages the tightening mechanism to releasably prevent rotation of the spool. In another embodiment, the tightening mechanism contains a ratchet and wheel and the locking mechanism includes a pawl. In yet another embodiment, the flexible lace includes a first end coupled to the housing and a second end coupled to the spool.

In another embodiment, the ligature also includes a control knob that is mechanically coupled to the spool. In another embodiment, the ligature also includes a pressure plate coupled to the flexible lace and having a cradle portion that is shaped to securely engage the mouthpiece at an antipodal point opposite of the housing.

In yet another embodiment, the cradle portion of the pressure plate and the cradle portion of the housing are lined with a vibration dampening material including: cork, plastic, leather, synthetic leather, silicone, rubber, cotton, fleece or vinyl. In another embodiment, the ligature can have a first insert that is positioned between the cradle portion of the housing and the reed and a second insert that is positioned between the cradle portion of the pressure plate and the mouthpiece. In yet another embodiment, the pressure plate includes an abrasion prevention guide creating separate lace guide channels within the pressure plate. In yet another embodiment, the pressure plate includes more than one lace guide channel for coupling to the flexible lace.

In another embodiment the ligature further includes a removable mouthpiece cover that is configured to releasably engage the housing and cover at least a portion of the mouthpiece and reed. The removable mouthpiece cover can include an engagement portion configured to engage a receiving slot of the ligature housing. Further, in some embodiments, the removable mouthpiece cover is shaped such that when it is engaged with the housing it makes no contact with the mouthpiece and reed.

In yet another embodiment, the ligature housing includes engagement arms configured to cradle the mouthpiece body. In some embodiments, the engagement arms are configured to releasably couple to the housing through the interaction of engagement ridges located on the engagement arms and receiving slots located on the housing. In yet another embodiment, the engagement arms are lined with a vibration dampening material including: cork, plastic, leather, synthetic leather, silicone, rubber, cotton, fleece or vinyl.

Embodiments disclosed herein also include a ligature for an instrument having a reed and mouthpiece, the ligature having a housing with a cradle portion shaped to engage the mouthpiece, a pressure plate with a cradle portion configured to engage the reed, a spool with a tightening mechanism, the spool being rotatably coupled to the housing. The ligature also includes a flexible lace that is coupled to the spool and the pressure plate and extending in a loop from the housing, the loop sized to extend around the circumference of the mouthpiece.

In another embodiment, the ligature also includes a control knob that is mechanically coupled to the spool. In another embodiment, the tightening mechanism contains a ratchet and wheel and the locking mechanism includes a pawl. In yet another embodiment, the flexible lace includes a first end coupled to the housing and a second end coupled to the spool and a middle portion coupled to the pressure plate.

In yet another embodiment, the cradle portion of the pressure plate and the cradle portion of the housing are lined with a vibration dampening material including: cork, plastic, leather, synthetic leather, silicone, rubber, cotton, fleece or vinyl. In another embodiment, the ligature can have a first insert that is positioned between the cradle portion of the housing and the mouthpiece and a second insert that is positioned between the cradle portion of the pressure plate and the reed. In yet another embodiment, the pressure plate includes an abrasion prevention guide creating separate lace guide channels within the pressure plate. In yet another embodiment, the pressure plate includes more than one lace guide channel for coupling to the flexible lace.

In another embodiment the ligature further includes a removable mouthpiece cover that is configured to releasably engage the housing and cover at least a portion of the mouthpiece and reed. The removable mouthpiece cover can include an engagement portion configured to engage a receiving slot of the ligature housing. Further, in some embodiments, the removable mouthpiece cover is shaped such that when it is engaged with the housing it makes no contact with the mouthpiece and reed.

In yet another embodiment, the ligature housing includes engagement arms configured to cradle the mouthpiece body. In some embodiments, the engagement arms are configured to releasably couple to the housing through the interaction of engagement ridges located on the engagement arms and receiving slots located on the housing. In yet another embodiment, the engagement arms are lined with a vibration dampening material including: cork, plastic, leather, synthetic leather, silicone, rubber, cotton, fleece or vinyl.

BRIEF DESCRIPTION OF THE FIGURES

The invention is pointed out with particularity in the appended claims. The advantages of the invention described herein, together with further advantages, may be better understood by referring to the following description taken in conjunction with the accompanying figures. In the figures, like reference characters generally refer to the same components throughout the different figures. The figures are not necessarily to scale, emphasis instead generally being placed upon illustrating the principles of the invention

DETAILED DESCRIPTION

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

The systems and methods of the present disclosure relate to an improved woodwind musical instrument ligature.

Figure 1B:
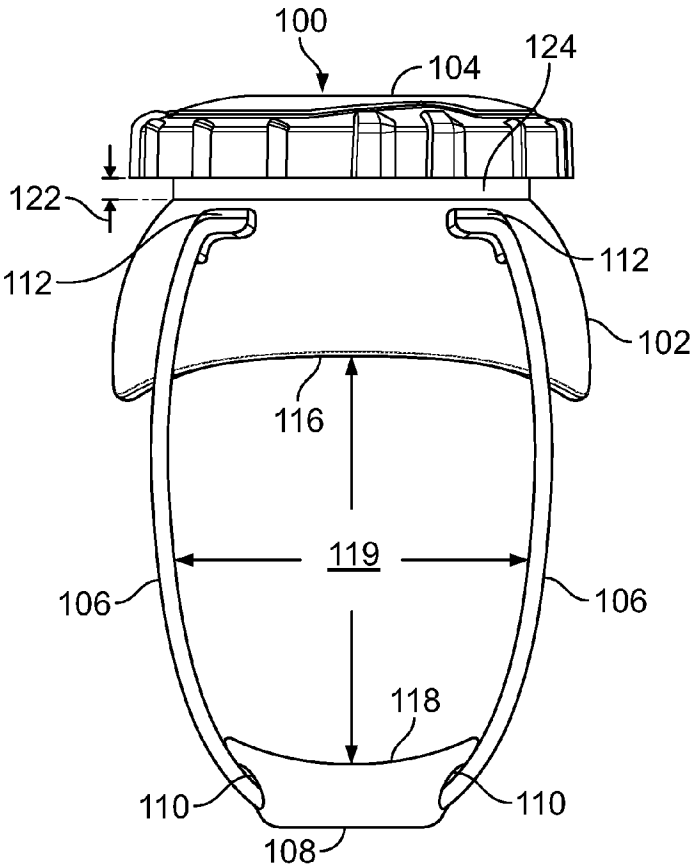
FIG. 1B depicts a frontal view of a ligature device according to an embodiment of the disclosed invention.
Figure 1A:
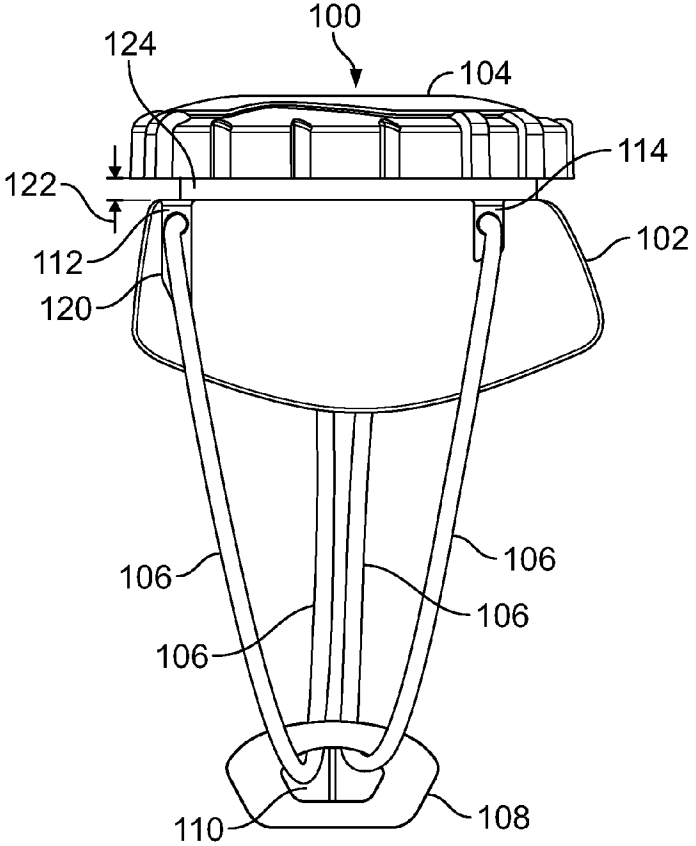
FIG. 1A depicts a side view of a ligature device according to an embodiment of the disclosed invention.

An exemplary embodiment of a ligature of the disclosed invention can be seen in FIGS. 1A-B. The ligature device 100 includes a housing 102 containing a molded cradle portion 116 designed such that it can rest securely upon a reed for a woodwind instrument without any portion of the housing 102 coming in direct contact with a mouthpiece. The ligature device 100 further includes a control knob 104 rotatably attached to the housing 102. The housing is designed such that its body cavity contains a spool and tightening mechanism that is mechanically coupled to the control knob 104. The housing 102 includes one or more lace guide entry holes 112 and lace groves 120 that provide lace access and guidance to the spool and tightening mechanism located within the housing body.

The ligature device 100 further includes a pressure plate 108 containing a molded cradle portion 118 designed such that it securely engages and applies pressure to a mouthpiece body diametrically opposite the housing cradle portion 116. A flexible lace 106 is utilized to connect the housing 102 to the pressure plate 108. A first end of the flexible lace 106 is removably secured to the spool within the housing cavity and is threaded through a lace entry hole 114. In alternate embodiments, the first end of the flexible lace 106 is removably secured to the interior of the housing cavity itself. The flexible lace 106 extends through a lace guide channel 110 of the pressure plate 108 and returns to the opposite side of the housing 102 from the first end and connects to the spool located within the housing cavity through a lace guide entry hole 112.

In some embodiments, the flexible lace 106 is a single continuous cable coupling the housing 102 to the pressure plate 108. In alternate embodiments, the flexible lace 106 can include multiple cables coupling the housing 102 and pressure plate 108. In some embodiments, the flexible lace 106 intersects and crosses over itself within the lace guide channel 110 of the pressure plate 108. In another embodiment, the pressure plate 108 can include more than one lace guide channel 110 thereby creating separate lace paths for the flexible lace through the pressure plate 108. These separate lace paths can help ensure even tightening of the flexible lace 106, reduce friction and prevent abrasion that can be caused where the flexible lace 106 crosses over itself.

The control knob 104, housing 102, pressure plate 108 and flexible lace 106 form a circumferential loop 119 when mechanically coupled. The circumferential loop 119 can be enlarged or reduced by lengthening or shortening the flexible lace 106 using the control knob 104 to rotate the spool and tightening mechanism located within the housing body. Any of a variety of known tightening mechanisms can be utilized to permit winding of the spool to increase tension on the lace 106, while resisting unwinding of the spool until desired. For example, any of a wide variety of ratchet structures can be used for this purpose. Alternatively, a sprag clutch or similar structure can permit one-way rotation of a shaft while resisting rotation in the opposite direction. One example of a suitable tightening mechanism is sold under the BOA® trademark and is disclosed in U.S. Pat. Nos. 6,289,558 and 7,992,261, the disclosures of which are incorporated by reference herein in their entireties.

As the flexible lace 106 is shortened, the pressure plate 108 is drawn closer to the housing 102 through the reduction in size of the circumferential loop 119. As the circumferential loop 119 nears the circumferential size of the mouthpiece and reed assembly to which the ligature 100 is being applied, the pressure plate cradle portion 118 engages the mouthpiece body. At or near the same time, the housing cradle portion 116 engages the reed exerting downward pressure on the reed resulting in the reed securely contacting the mouthpiece body. The housing cradle portion 116 and pressure plate cradle portion 118 make contact with the mouthpiece and reed assembly at or substantially near antipodal points diametrically opposite one another. In some embodiments, the ligature 100 can be rotated 180 degrees relative to the mouthpiece and reed assembly such that the housing cradle portion 116 engages the mouthpiece body and the pressure plate cradle portion 116 engages the reed. The enlargement and reduction qualities of the circumferential loop 119 of the ligature 100 enables the ligature 100 to be applied universally to a variety of woodwind mouthpiece and reed assemblies regardless of size.

In another embodiment, the pressure plate 108 can be removed from the ligature device. In this embodiment, the control knob 104, housing 102, and flexible lace 106 form a circumferential loop 119 when mechanically coupled. As the lace 106 is shortened it is drawn closer to the housing 102 through the reduction in size of the circumferential loop 119. As the circumferential loop 119 nears the circumferential size of the mouthpiece and reed assembly to which the ligature 100 is being applied, the flexible lace 106 engages the mouthpiece body. At or near the same time, the housing cradle portion 116 engages the reed exerting downward pressure on the reed resulting in the reed securely contacting the mouthpiece body. The housing cradle portion 116 and flexible lace 106 make contact with the mouthpiece and reed assembly at or substantially near antipodal points diametrically opposite one another.

In one embodiment, the housing cradle portion 116 and/or the pressure plate cradle portion 118 can be lined with a vibration dampening pad to reduce the amount of vibration, friction and/or reverberation as well as providing firmer grip support in maintaining the reed's 206 placement with respect to the mouthpiece 200. The vibration dampening pad can be comprised of suitable dampening materials, including but not limited to, cork, plastic, rubber, leather, silicone, cotton, fleece and other such vibration insulating materials. In another embodiment, an insert and/or spacer can be interchangeably placed between the housing cradle portion 116 and/or the pressure plate cradle portion 118 to ensure proper pressure is applied to the reed and mouthpiece body.

The flexible lace 106 can be formed from any flexible elongate material with sufficient axial strength to maintain the desired tension levels, and can comprise, for example, a polymer, a metal, or combinations thereof. For example, any of a wide variety of solid core wires, solid core polymers, or multi-filament wires or polymers, which may be woven, braided, twisted or otherwise oriented, can be used. To reduce friction between the flexible lace 106 and the ligature housing 102 and pressure plate 108, the outer surface of the flexible lace can be coated with any of a wide variety of low friction materials, including without limitation, nylon or Teflon. The tips or ends of the flexible lace can be sealed or bonded to ensure that the flexible lace core material is retained together to prevent separation of the solid core or strands. These tips or ends of the flexible lace 106 can also act as a terminal anchor point for attaching the flexible lace 106 to the spool, tightening mechanism or housing 102. Any of a variety of attachment structures for attaching the ends of the lace 106 to the spool can be used. For example, the lace 106 can be attached to the spool by threading the lace through an aperture and providing a transversely oriented set screw so that the set screw can be tightened against the lace 106. The use of set screws or other releasable clamping structures facilitates disassembly and reassembly of the ligatured device 100 and replacement of the lace 106. A housing ring 124 and an engagement gap 122 are discussed below.

Figure 2:
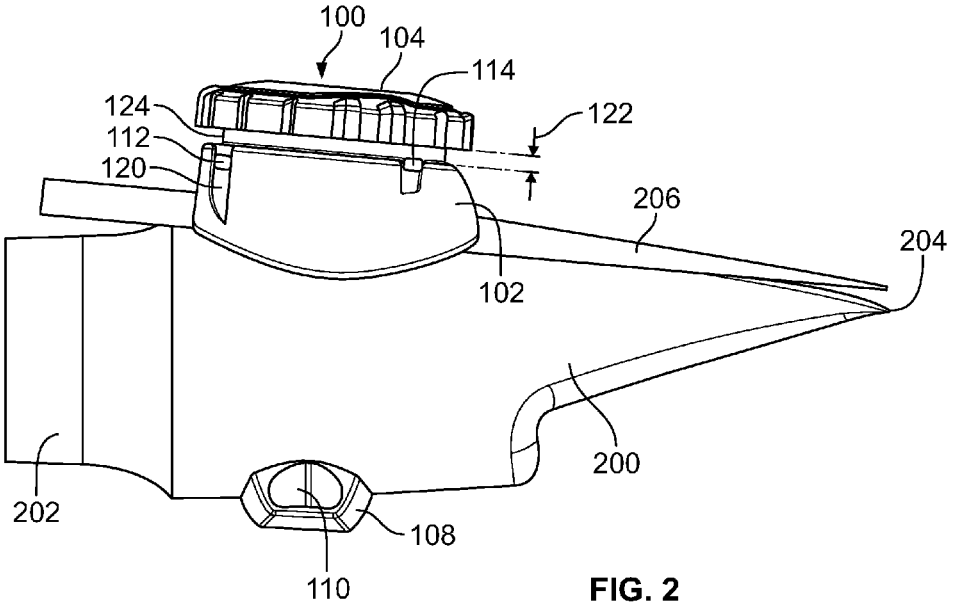
FIG. 2 depicts a side view of a mouthpiece utilizing the ligature device of FIGS. 1A-B.

FIG. 2 illustrates the application of the ligature 100 shown in FIGS. 1A-1B to a mouthpiece 200 and reed 206 assembly. A single-reed mouthpiece 200 has a generally tubular central portion with a tapered front portion for insertion into the musician's mouth, and a rear portion 202 which is shaped so as to couple with the next portion of the woodwind instrument (e.g., in a clarinet, the cylindrical rear portion is sized so as to be received into the barrel of the clarinet). The front portion typically includes a substantially flat portion, against which the reed is pressed by the ligature, and a table portion, which curves away from the reed to create an opening for air to be received into an opening 204 in the front end portion. The ligature 100 is designed to surround the mouthpiece 200 and the reed 206 to secure the reed to the mouthpiece in a position creating the desired opening 204.

Figure 3:
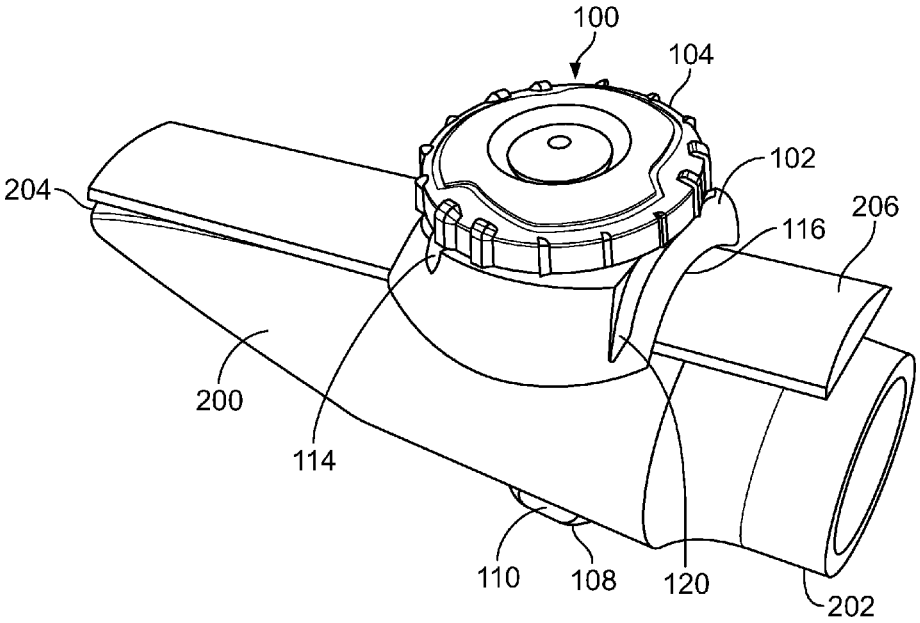
FIG. 3 depicts a rear perspective view of a mouthpiece utilizing the ligature device of FIGS. 1A-B.
Figure 4:
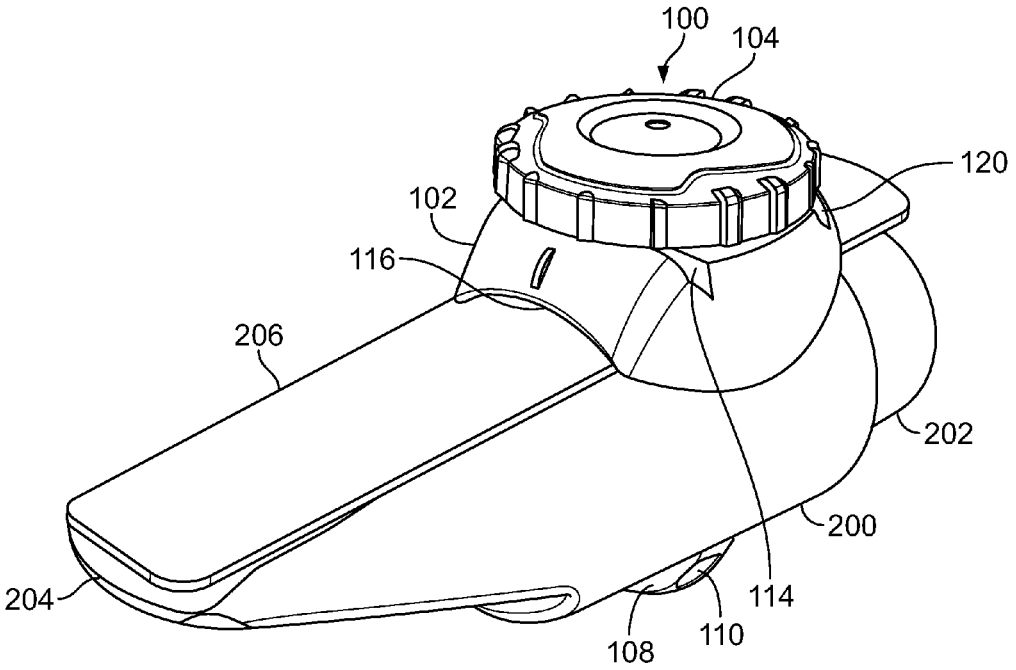
FIG. 4 depicts a front perspective view of a mouthpiece utilizing the ligature device of FIGS. 1A-B.
Figure 5A:
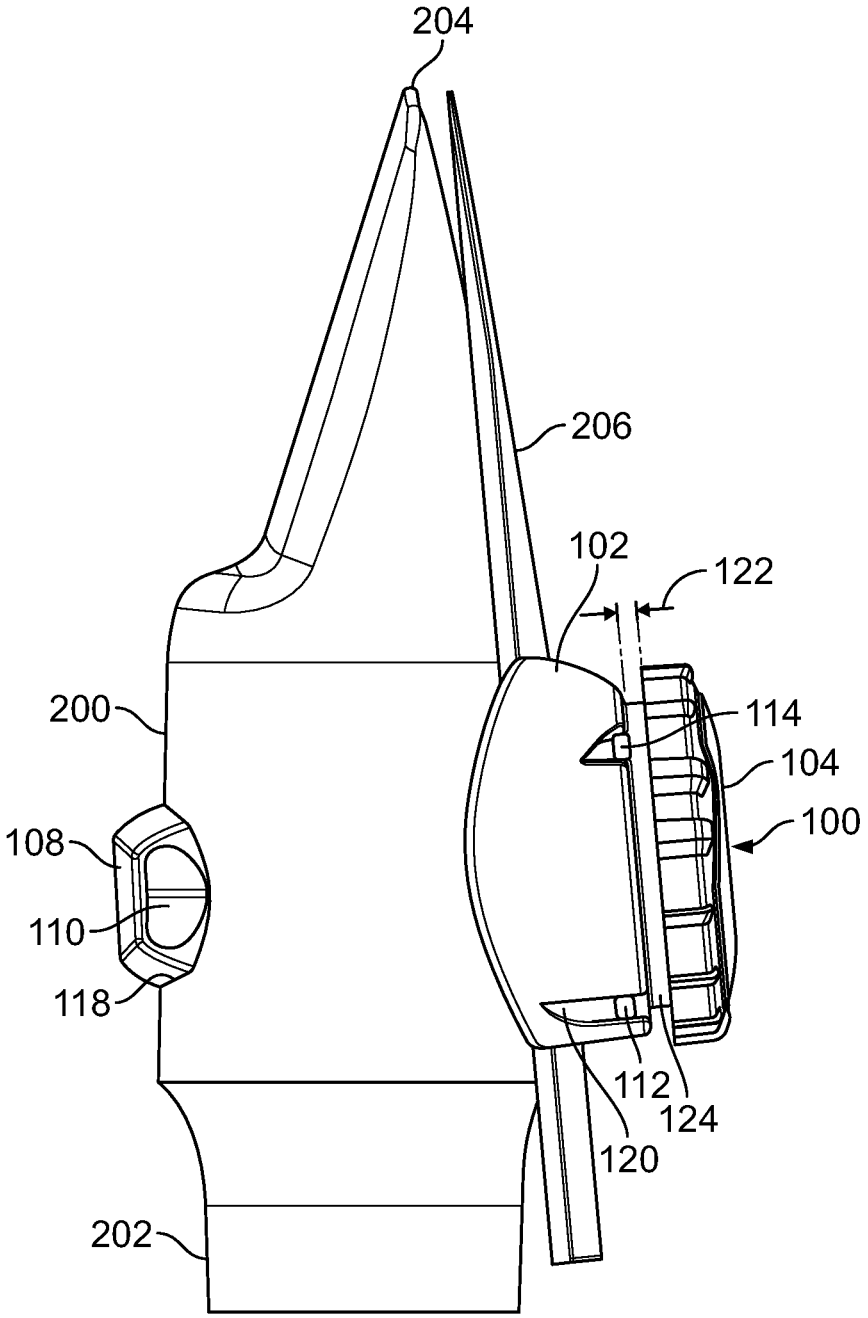
FIGS. 5A-C depict views of the ligature device of FIGS. 1A-B utilized on an alto mouthpiece.
Figure 5B:
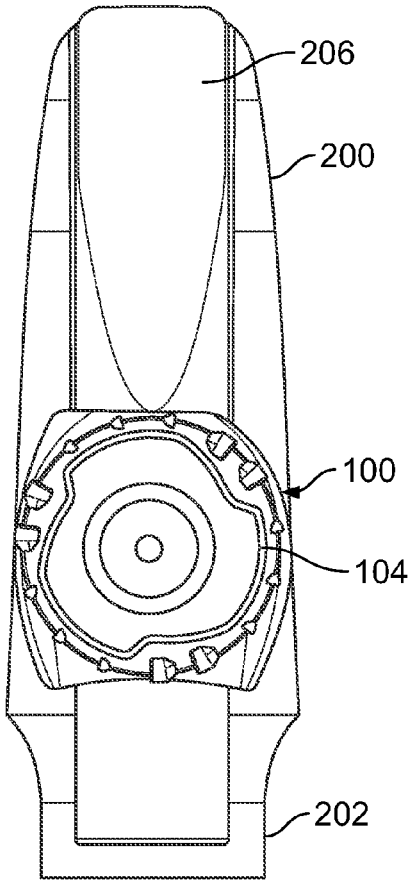
Figure 5C:
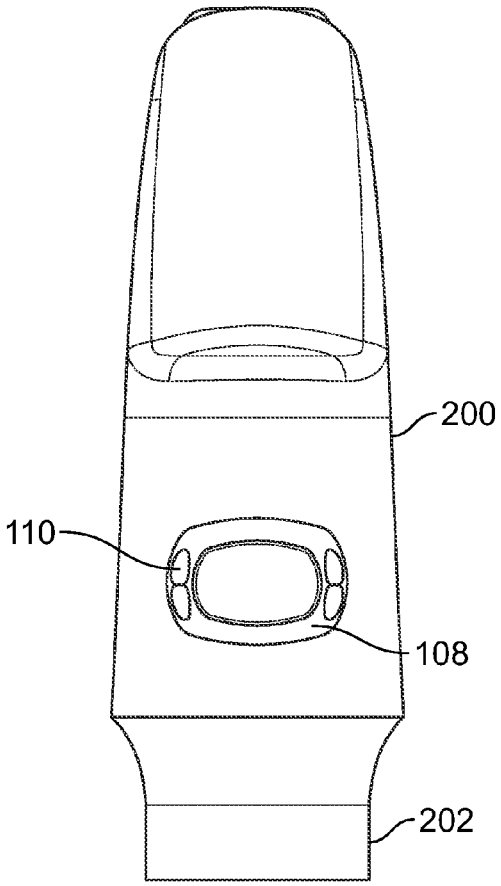
Figure 6A:
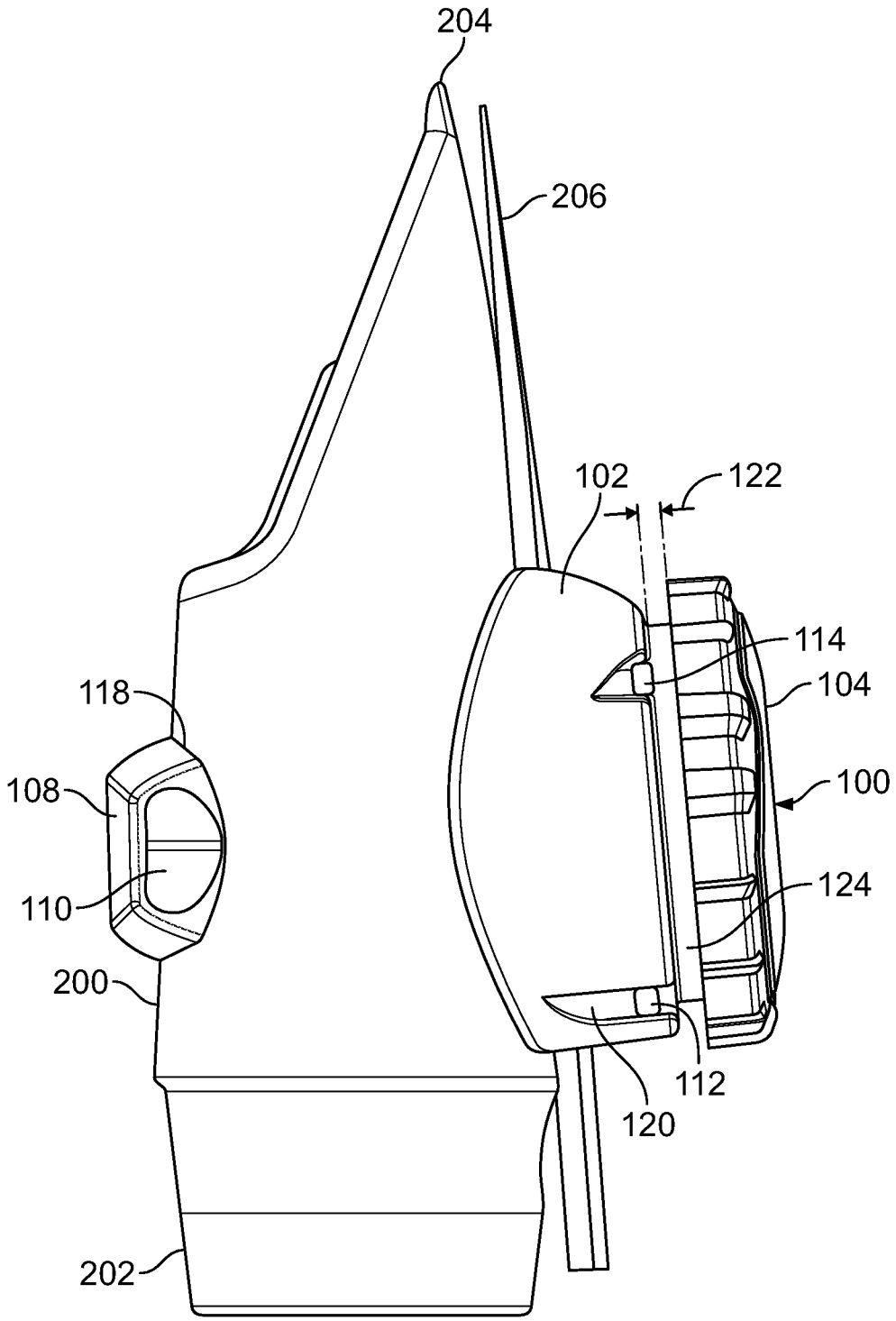
FIG. 6A-C depict views of the ligature device of FIGS. 1A-B utilized on an soprano mouthpiece.
Figure 6B:
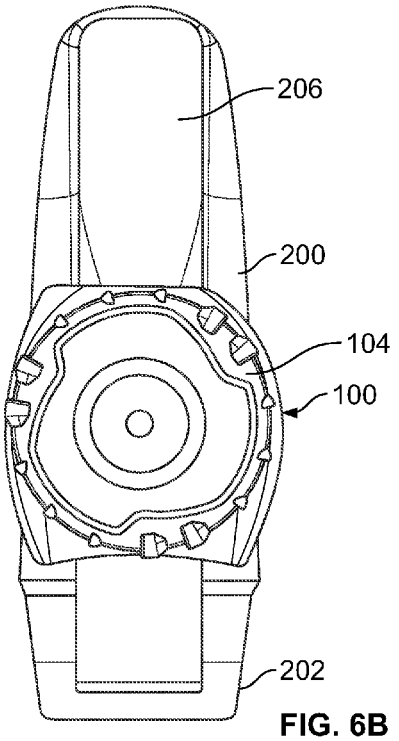
Figure 6C:
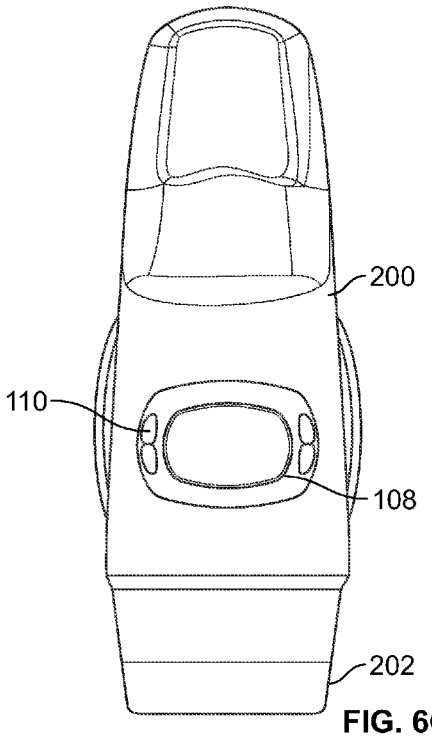

FIGS. 3 and 4 illustrate rear and front perspective views, respectively, of the application of the ligature 100 as shown in FIGS. 1A-B to a mouthpiece and reed assembly. In the illustrated embodiment, the housing cradle portion 116 engages the reed 206, while the housing body 102 does not contact the mouthpiece body 200.

FIGS. 5A-5C and 6A-6C illustrate multi-angle views of the application of the ligature 100 as shown in FIGS. 1A-B to an Alto and Soprano mouthpiece assembly respectively. A musician utilizing a traditional metal band ligature would need two separate ligatures for the mouthpieces illustrated. The ligature 100 of the present disclosure can be universally applied to a wide range of mouthpiece sizes.

Figure 7:
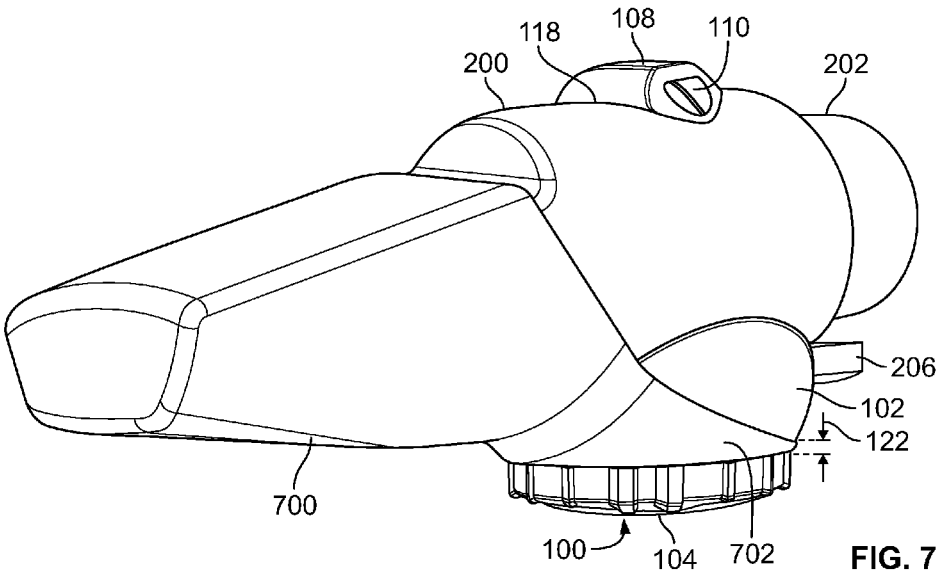
FIG. 7 depicts an inverted front perspective view of a mouthpiece and mouthpiece cover utilizing the ligature device of FIGS. 1A-B.

FIG. 7 illustrates the application of the ligature 100 as shown in FIGS. 1A-B to a mouthpiece 200. In this embodiment, the housing 102 is configured to releasably receive a mouthpiece cover 700. The mouthpiece cover 700 contains one or more receiving arms 702 designed to releasably engage the housing 102. The one or more receiving arms 702 are configured to fit within the engagement gap 122 located between the control knob 104 and the main portion of the housing body 102. The one or more receiving arms releasably apply substantially circumferential pressure to the housing ring 124 as shown in FIGS. 1A-B, 2, 5A and 6A. In one embodiment, the mouthpiece cover 700 is designed such that when one or more receiving arms 702 are releasably engaged with the housing 102, the interior sides of the mouthpiece cover 700 and the mouthpiece assembly comprised of the mouthpiece 200 and reed 206 have zero points of contact, or, in some embodiments, minimal points of contact.

Figure 8:
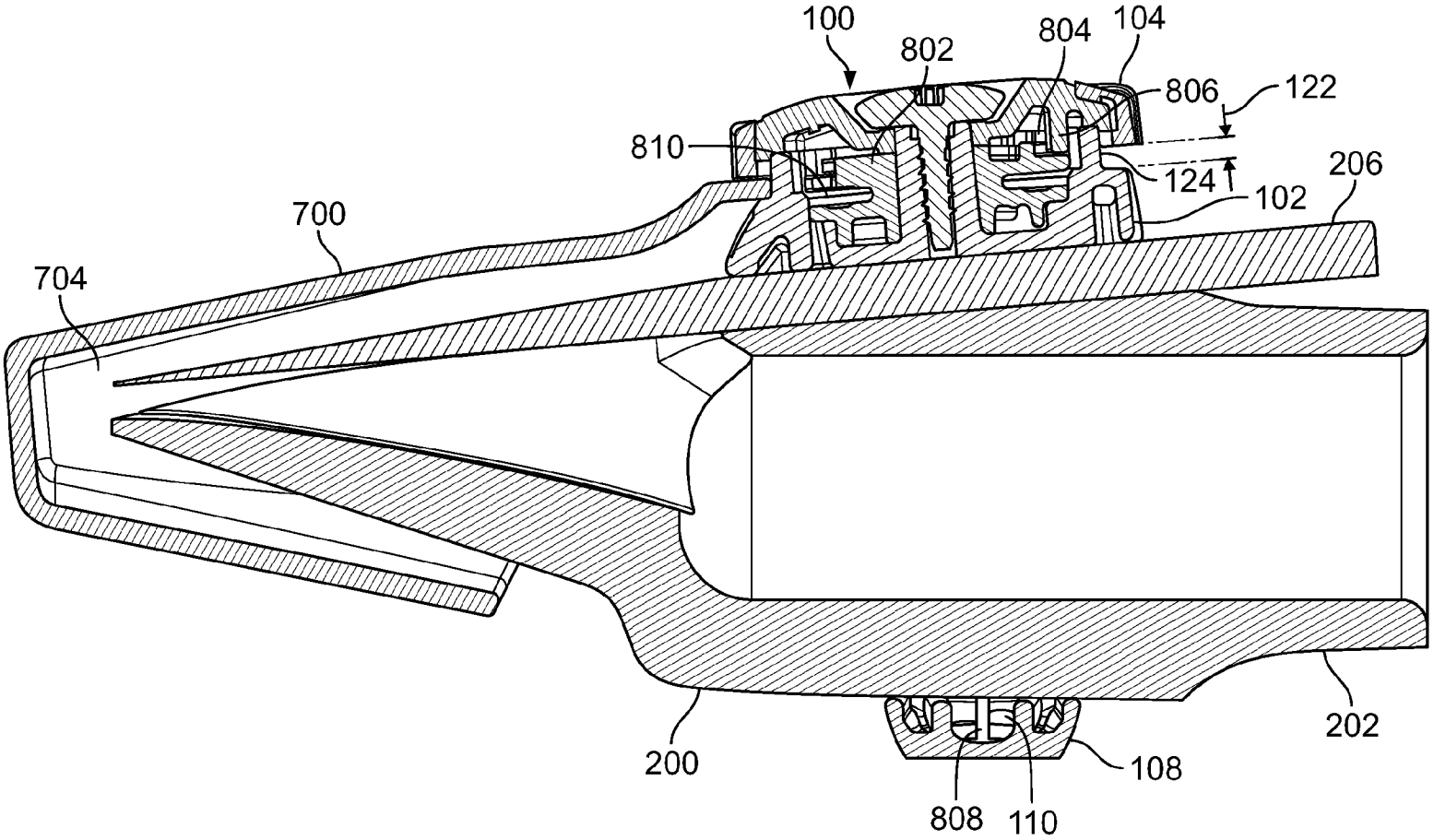
FIG. 8 depicts a cross sectional view of a mouthpiece and mouthpiece cover utilizing the ligature device of FIGS. 1A-B.

FIG. 8 represents a cross-sectional view of an embodiment of the present disclosure. The cross-sectional view of the mouthpiece cover 700 illustrates a gap 704 between the mouthpiece cover 700 and the mouthpiece assembly. Accordingly, there are zero points of contact between the mouthpiece cover 700 and the mouthpiece assembly comprised of the mouthpiece 200 and the reed 206. FIG. 8 further illustrates the mouthpiece cover's 700 releasable engagement with the housing ring 124 within the engagement gap 122 located between the control knob 104 and the housing body 102. For some users, it may be desirable that the cover 700 not contact the mouthpiece 200 and reed 206 to minimize risk of damage to both the mouthpiece 200 and the reed 206. This is particularly important as any damage to the tip of the mouthpiece 200 can render it unusable.

As previously described, FIG. 8 illustrates that the housing 102 is designed such that its body cavity contains a spool 802 and tightening mechanism 804 that is mechanically coupled to the control knob 104. In this embodiment, the ligature 100 further includes a pawl 806 which is mechanically coupled to the control knob 104 and releasably engages the tightening mechanism 804 to prevent unwinding of the spool 802 until desired. As the control knob 104 is rotated, the tightening mechanism 804 and spool 802 draw the flexible lace 106 through the lace guide entry hole 112. The flexible lace 106 is wound around the spool 802 and collected within a lace collection grove 810.

In addition to the lace guide channels 110, the pressure plate 108 can also include an abrasion prevention guide 808. This abrasion prevention guide 808 creates two lace guide channels 110 in the pressure plate 108 to prevent portions of the flexible lace 106 from coming into contact with other portions of the flexible lace 106. This can help ensure that the flexible lace 106 does not become entangled or come into overlapping contact as it is drawn through the pressure plate 108 into the lace collection grove 810 of the spool 802. In this embodiment, the two lace guide channels 110 are side-by-side; however, it will be appreciated that the orientation of the abrasion prevention guide 808 with respect to the pressure plate can create lace guide channels that cross or overlap each other while maintaining separation between the lace.

Figure 9:
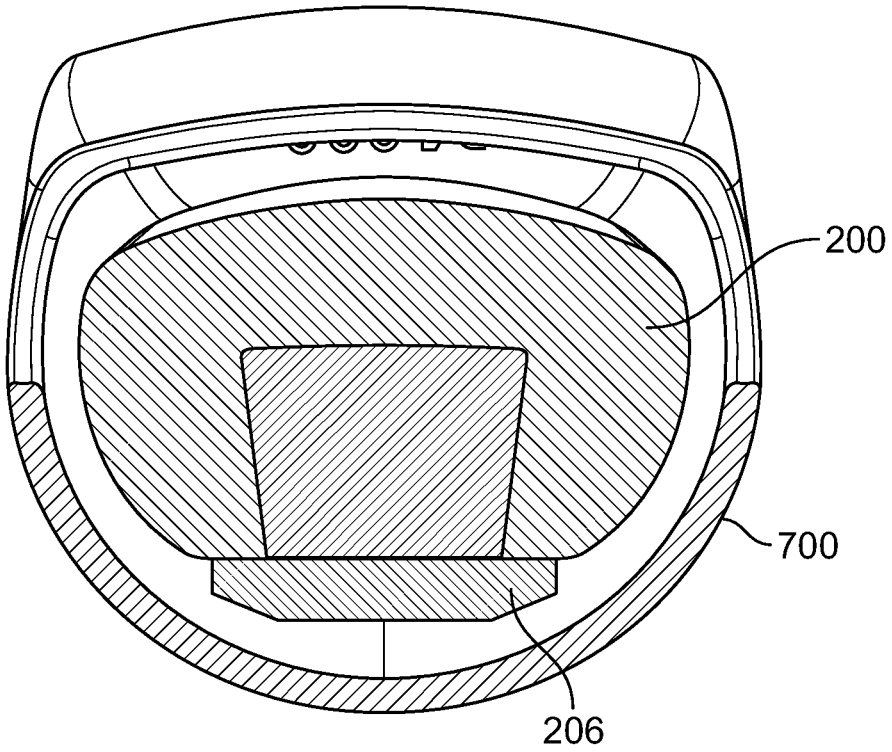
FIG. 9 depicts a cross sectional inverted view of a mouthpiece and mouthpiece cover according to an embodiment of the disclosed invention.

FIG. 9 represents a cross-sectional rear view of the mouthpiece cover 700 and its orientation with respect to the mouthpiece 200 and the reed 206. In this embodiment the distance between the inside surface of the mouthpiece cover 700 and the outside surface of the mouthpiece assembly consisting of the mouthpiece 200 and the reed 206 is approximately 1.5 mm. It will be appreciated that this distance and the diameter of the mouthpiece cover can be varied to fit specific desired space dimensions and other design considerations.

Figure 10:
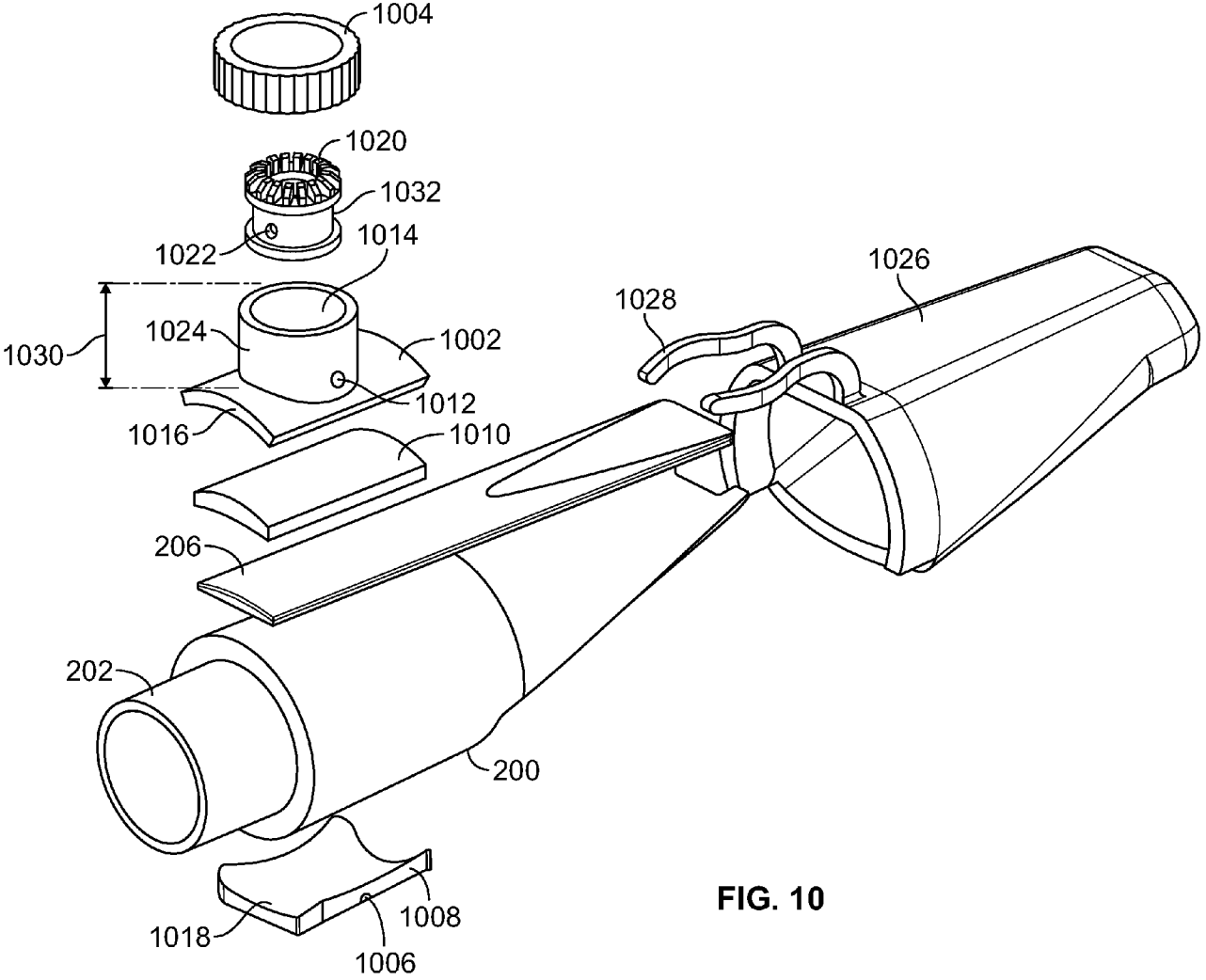
FIG. 10 depicts an exploded perspective view of a mouthpiece and mouthpiece cover utilizing a ligature device according to an embodiment of the disclosed invention.

FIG. 10 is an exploded view of a ligature and a mouthpiece cover embodiment of the disclosed invention utilized on a mouthpiece and reed assembly. The ligature includes a housing 1002 which contains a molded cradle portion 1016 such that it can rest securely upon a reed 206 or alternatively on a similarly contoured spacer plate or vibration dampening pad 1010. The housing 1002 further includes a housing ring 1024 upon which is situated one or more lace guide entry holes 1012. The housing ring 1024 as shown is cylindrical; however, it will be appreciated that the housing ring 1024 can be any number of geometric shapes. An engagement gap 1030 is similar to the engagement gap 122 described above.

The housing ring 1024 of the present embodiment contains a hollow core forming a tubular cavity 1014. As the housing ring shape can vary so too can the geometric shape of the housing ring's hollow core. The ligature of the present embodiment further includes a spool 1032 that is rotatably coupled to the housing 1002 and is designed to fit within the housing ring cavity 1014. The spool 1032 contains one or more lace receiving holes 1022 that can be utilized as terminal anchor points. In some embodiments, the spool can also include a ratchet portion 1020 configured to mechanically couple with a control knob 1004. By rotating the control knob 1004 in a first direction, the spool 1032 will rotate and draw up the flexible lace through the lace guide entry holes 1012 located on the housing ring 1024. The lace will then wrap around the spool 1032. By rotating the control knob 1004 in a second direction, the spool 1032 will rotate and release the flexible lace through the lace guide entry holes 1012 located on the housing ring 1024.

As noted, the ligature can include a spacer plate or vibration dampening pad 1010. The spacer plate or vibration dampening pad 1010 can be loose or affixed to the housing body 1002 such that a first side makes contact with the housing body 1002 and a second side makes contact with the reed 206. The ligature also includes a pressure plate 1008 which contains a molded cradle portion 1018 such that it securely engages and applies pressure to a mouthpiece body 200 at a point diametrically opposite the housing cradle portion 1016. The pressure plate 1008 can also include one or more lace guide channels 1006 that provide guidance for the flexible lace.

The housing ring 1024 can also be configured such that the distance between the top of the lace guide entry holes 1012 and the top of the housing ring 1024 is capable of removably engaging with one or more mouthpiece cover receiving arms 1028. The mouthpiece receiving arms act as the connection means between the ligature device and the mouthpiece cover 1026.

Figure 11A:
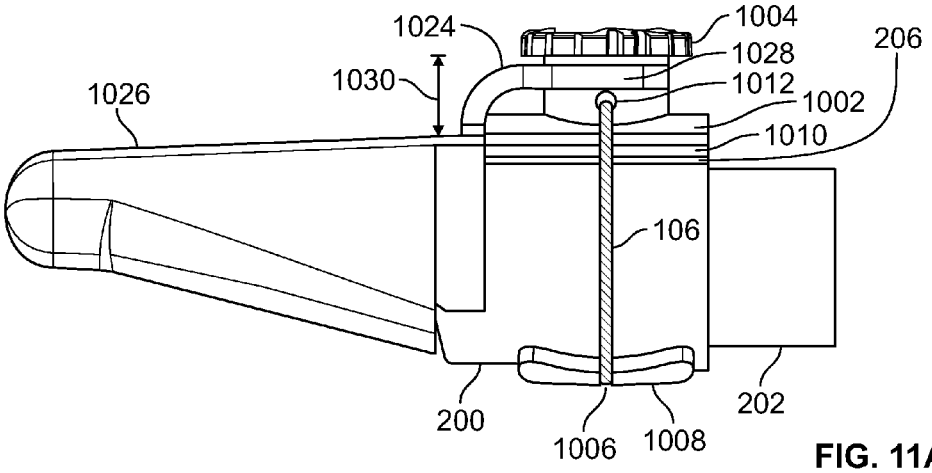
FIGS. 11A-C depicts a side view of the ligature device of FIG. 10.
Figure 11B:
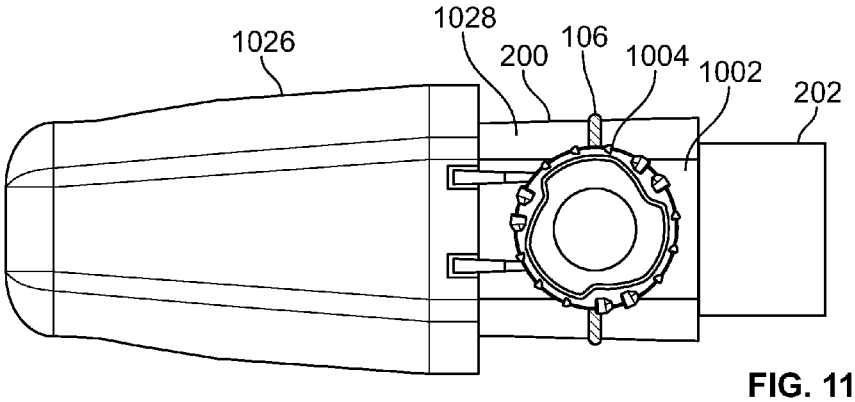
Figure 11C:
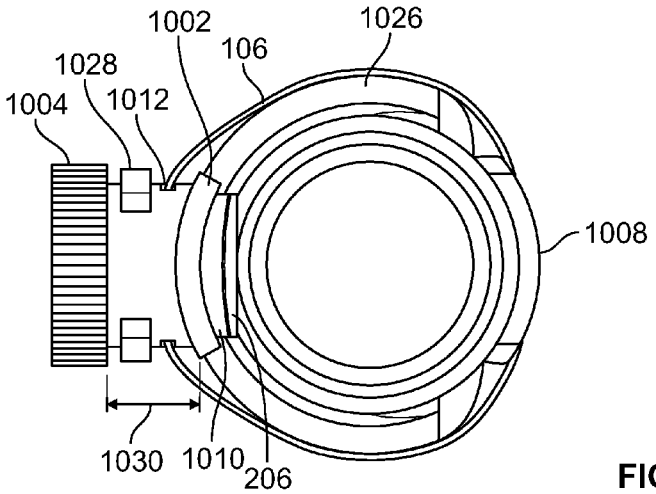

FIGS. 11A-C represent the side, top and rear views of the ligature device and mouthpiece cover as shown in FIG. 10. As can be seen, the control knob 1004, housing 1002, optional spacer plate or vibration dampening pad 1010, pressure plate 1008 and flexible lace 106 form a circumferential loop around the mouthpiece assembly comprised of the mouthpiece 200 and reed 206. As with the ligature's application in the embodiment illustrated in FIGS. 1A-B, this circumferential loop can be enlarged or reduced by the lengthening or shortening of the flexible lace 106 using the control knob 1004 to rotate the spool and tightening mechanism located within the housing ring cavity. As the lace 106 is shortened, the pressure plate 1008 is drawn closer to the housing 1002 through the reduction in size of the circumferential loop. As the circumferential loop nears the circumference of the mouthpiece and reed assembly to which the ligature is being applied, the pressure plate cradle portion 1018 engages the mouthpiece body. At or near the same time, the housing cradle portion 1016 engages the reed 206 exerting downward pressure on the reed 206 resulting in the reed securely contacting the mouthpiece body 200. The housing cradle portion 1016 and pressure plate cradle portion 1018 make contact with the mouthpiece and reed assembly at or substantially near antipodal points diametrically opposite one another. In some embodiments, the ligature can be rotated 180 degrees relative to the mouthpiece and reed assembly such that the housing cradle portion 1016 engages the mouthpiece body and the pressure plate cradle portion 1018 engages the reed. The enlargement and reduction qualities of the circumferential loop of the ligature enables this ligature to be applied universally to all woodwind mouthpiece and reed assemblies regardless of size.

Figure 12:
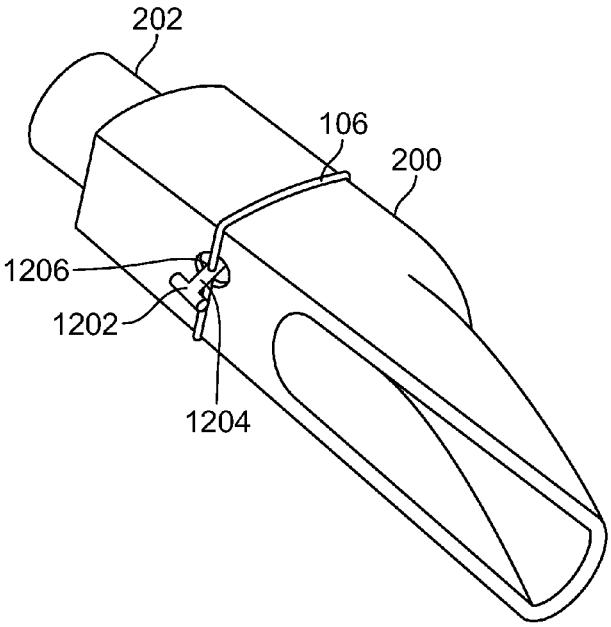
FIG. 12 depicts a front perspective view of a mouthpiece utilizing a ligature according to an embodiment of the disclosed invention.

FIG. 12 illustrates an alternative ligature embodiment of the disclosed invention. In this embodiment a rotatable screw 1202 is utilized as an alternative tightening mechanism. The rotatable screw 1202 is mechanically coupled to a mouthpiece body 200. The rotatable screw 1202 includes one or more lace receiving holes 1206 that can operate a terminal anchor points. The rotatable screw shaft 1204 acts as a spool around which the flexible lace 106 winds or unwinds as the rotatable screw is rotationally activated.

Figure 13:
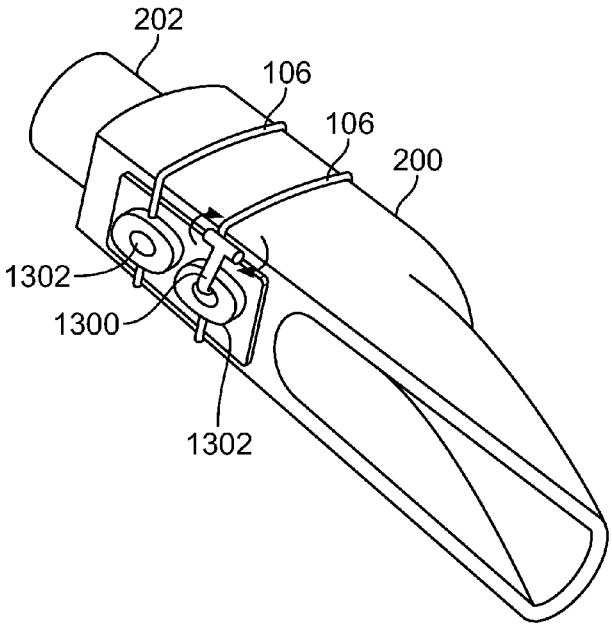
FIG. 13 depicts a front perspective view of a mouthpiece utilizing a ligature according to an embodiment of the disclosed invention.

FIG. 13 illustrates yet another ligature embodiment of the disclosed invention. In this embodiment a plurality of spools 1302 and tightening mechanisms 1300 can be used to tighten the flexible lace 106 around the mouthpiece body 200.

Figure 14:
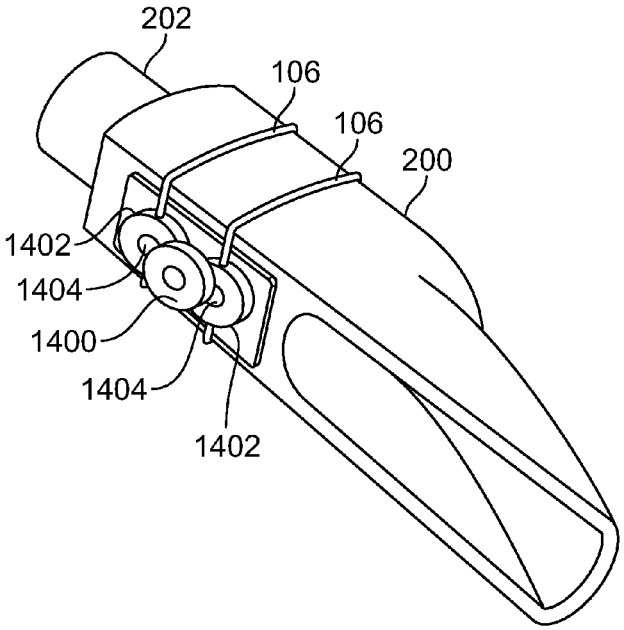
FIG. 14 depicts a front perspective view of a mouthpiece utilizing a ligature according to an embodiment of the disclosed invention.

FIG. 14 illustrates another embodiment of the disclosed invention. In this embodiment a plurality of spools 1402 containing ratchet wheels 1404 are mechanically coupled to a control knob 1400.

Figure 15:
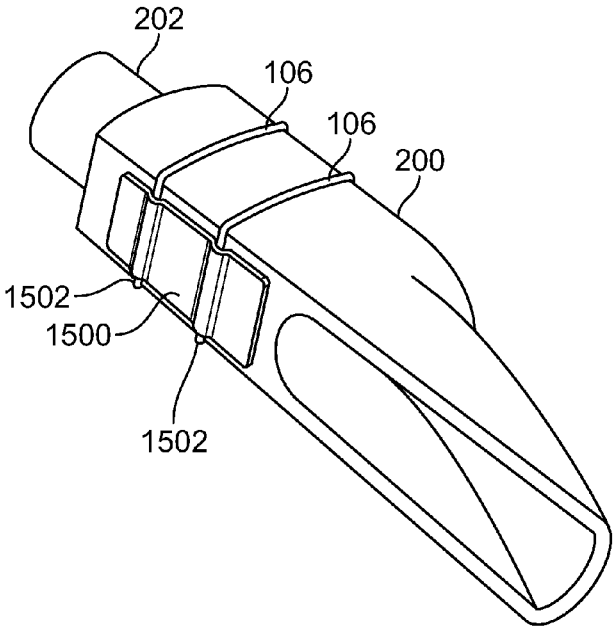
FIG. 15 depicts a front perspective view of a mouthpiece utilizing a ligature according to an embodiment of the disclosed invention.
Figure 16:
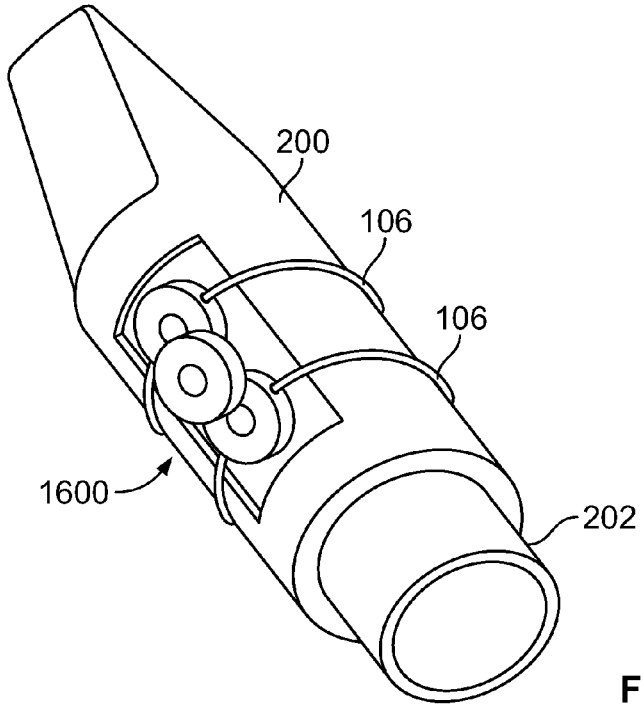
FIG. 16 depicts a rear inverted perspective view of a mouthpiece utilizing a ligature according to an embodiment of the disclosed invention.

FIGS. 15 and 16 illustrate alternative applications to ligature embodiments of the disclosed invention. FIG. 15 illustrates the use of a pressure plate 1500 containing one or more flexible lace guide channels 1502 to rest securely upon the reed as opposed to applying pressure to the mouthpiece body 200. With such application, the ligature device 1600, as shown in FIG. 16, would apply pressure to the mouthpiece body 200 at a point diametrically opposite the pressure plate 1500.

Figure 17:
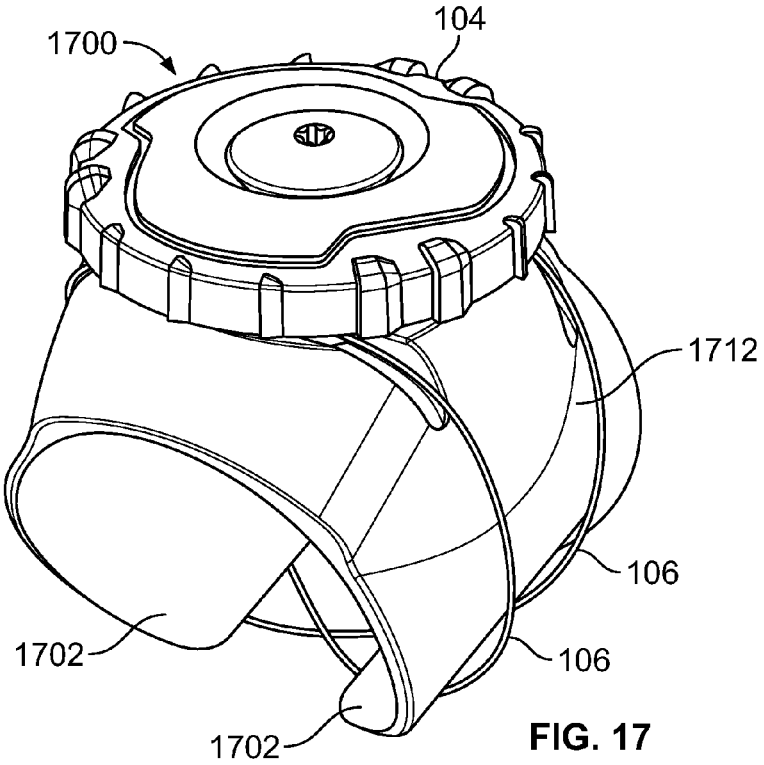
FIG. 17 depicts a front perspective view of a ligature according to an embodiment of the disclosed invention.

FIG. 17 illustrates an exemplary embodiment of a ligature of the disclosed invention. The ligature 1700 is designed to surround a mouthpiece and reed to secure the reed to the mouthpiece. The ligature 1700 of this exemplary embodiment is similar to the ligature 100 as shown in FIGS. 1A-B. However, the housing 1712 of this exemplary embodiment is configured such that it includes molded engagement arms 1702. These molded engagement arms 1702 are designed to releasably cradle a mouthpiece body further ensuring that the ligature 1700 securely fastens to the mouthpiece and reed assembly through the application and engagement of the tightening mechanism as detailed herein. The molded engagement arms 1702 can be lined with a vibration dampening pad to reduce the amount of vibration, friction and/or reverberation as well as increase friction between the ligature 1700 and the mouthpiece so as to provide a firmer grip support in maintaining the ligature's 1700 placement with respect to the mouthpiece. The vibration dampening pad can be comprised of suitable dampening materials, including but not limited to, cork, plastic, rubber, leather, silicone, cotton, fleece and other such vibration insulating materials.

Figure 18:
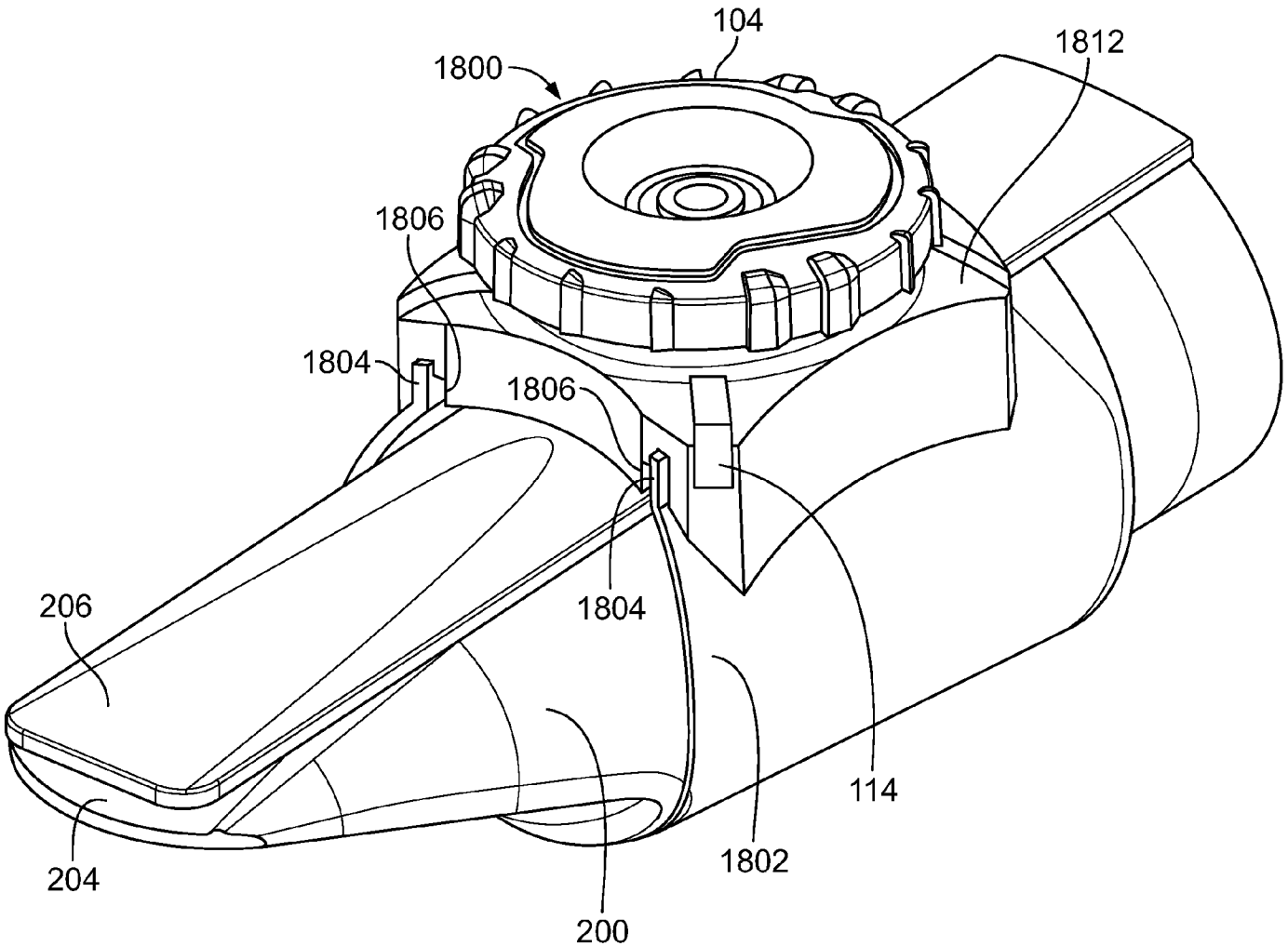
FIG. 18 depicts a front perspective view of a mouthpiece utilizing a ligature according to an embodiment of the disclosed invention.

FIG. 18 illustrates the application of an alternative ligature embodiment of the disclosed invention. The ligature 1800 of FIG. 18 is similar to that shown in FIG. 17, except that the engagement arms 1702 of ligature 1700 in FIG. 17 are integrally formed (e.g., integrally molded) with the housing 1712. In the embodiment shown in FIG. 18, the engagement arms 1802 are releasably coupled with the housing 1812. The engagement arms 1802 include housing securing ridges 1804 which releasably couples to the housing 1812. The housing securing ridges 1804 releasably coupled to the housing 1812 by engaging with receiving slots 1806 molded within the housing 1812. The engagement arms 1802 of FIG. 18 can be lined with a vibration dampening pad, similar to the vibration dampening pad described above with respect to FIG. 17

Figure 19:
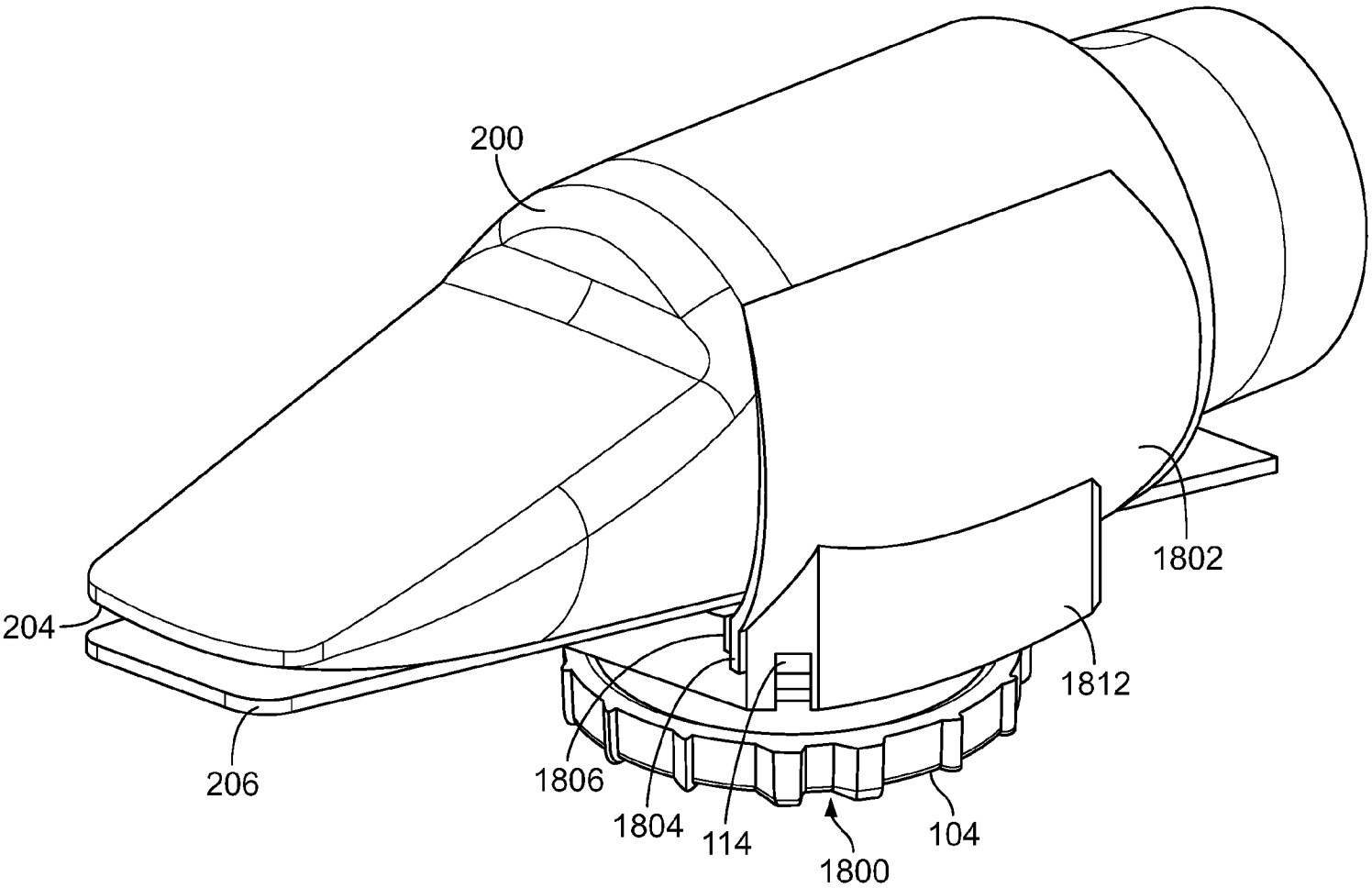
FIG. 19 depicts an inverted front perspective view of a mouthpiece utilizing a ligature according to an embodiment of the disclosed invention

FIG. 19 illustrates an inverted view of the ligature embodiment as shown in FIG. 18. This figure illustrates the releasable engagement of the engagement arms 1802 with the mouthpiece body 200. In this embodiment, the engagement arms 1802 are sized so as to partially envelop the mouthpiece body 200. In other embodiments, the engagement arms 1802 may be shorter or longer so as to extend varying distances along the circumference of the mouthpiece body 200. It will be appreciated that the size of the engagement arms 1802 can be varied to fit specific desired mouthpiece body dimensions and other design considerations.

Groupings of alternative elements or embodiments of the present disclosure are not to be construed as limitations. Each group member may be referred to and claimed individually or in any combination with other members of the group or other elements found herein. It is anticipated that one or more members of a group may be included in, or deleted from, a group for reasons of convenience. When any such inclusion or deletion occurs, the specification is deemed to contain the group as modified thus fulfilling the written description of all Markush groups used in the appended claims.

It is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A ligature for an instrument having a reed and a mouthpiece, comprising:

a housing having a cradle portion shaped to engage the reed;

a spool rotatably coupled to the housing, the spool including a tightening mechanism;

a flexible lace coupled to the spool and extending in a loop from the housing, said loop being sized to extend around the circumference of the mouthpiece; and a locking mechanism coupled to the housing and engaging the tightening mechanism to releasably prevent rotation of the spool.

2. The ligature of claim 1 further comprising a control knob mechanically coupled to the spool.

3. The ligature of claim 1 further comprising a pressure plate having a cradle portion configured to securely engage the mouthpiece at an antipodal point opposite of the housing, said pressure plate being coupled to said flexible lace.

4. The ligature of claim 3 wherein the cradle portion of the pressure plate and cradle portion of the housing are lined with a vibration dampening material comprising cork, plastic, leather, synthetic leather, silicone, rubber, cotton, fleece or vinyl.

5. The ligature of claim 3 further comprising:

a first insert positioned between the cradle portion of the housing and the reed; and a second insert positioned between the cradle portion of the pressure plate and the mouthpiece.

6. The ligature of claim 3 wherein the pressure plate further comprises an abrasion prevention guide configured to separate the flexible lace.

7. The ligature of claim 3 wherein the pressure plate further comprises one or more lace guide channels configured to receive the flexible lace.

8. The ligature of claim 1 wherein the tightening mechanism comprises a ratchet wheel and the locking mechanism comprises a pawl.

9. The ligature of claim 1 further comprising a removable mouthpiece cover configured to releasably engage the housing and cover at least a portion of the mouthpiece and reed.

10. The ligature of claim 9 wherein said removable mouthpiece cover is shaped such that when the removable mouthpiece cover is engaged with the housing, the removable mouthpiece cover is not in contact with the mouthpiece and reed.

11. The ligature of claim 1 wherein the housing further comprises a slot portion for receiving an engagement portion of a removable mouthpiece cover.

12. The ligature of claim 1 wherein the flexible lace has a first end coupled to the housing and a second end coupled to the spool.

13. The ligature of claim 1 wherein the housing further comprises engagements arms configured to releasably cradle the mouthpiece body.

14. The ligature of claim 13 wherein the engagement arms are lined with a vibration dampening material comprising cork, plastic, leather, synthetic leather, silicone, rubber, cotton, fleece or vinyl.

15. The ligature of claim 13 wherein the housing further comprises receiving slots and the engagement arms further comprise engagement ridges, said receiving slots configured to releasably couple with the engagement ridges of the engagement arms.

16. A ligature for an instrument having a reed and a mouthpiece, comprising:

a housing having a cradle portion shaped to engage the mouthpiece;

a pressure plate having a cradle portion configured to engage the reed;

a spool rotatably coupled to the housing, the spool including a tightening mechanism;

a flexible lace coupled to the spool and the pressure plate extending in a loop from the housing, said loop being sized to extend around the circumference of the mouthpiece; and a locking mechanism coupled to the housing and engaging the tightening mechanism to releasably prevent rotation of the spool.

17. The ligature of claim 16 further comprising a control knob mechanically coupled to the spool.

18. The ligature of claim 16 wherein the tightening mechanism comprises a ratchet wheel and the locking mechanism comprises a pawl.

19. The ligature of claim 16 wherein the cradle portion of the pressure plate and the cradle portion of the housing are lined with a vibration dampening material comprising cork, plastic, leather, synthetic leather, silicone, rubber, cotton, fleece or vinyl.

20. The ligature of claim 16 further comprising:

a first insert positioned between the cradle portion of the housing and the mouthpiece; and a second insert positioned between the cradle portion of the pressure plate and the reed.

21. The ligature of claim 16 further comprising a removable mouthpiece cover configured to releasably engage the housing and cover at least a portion of the mouthpiece and reed.

22. The ligature of claim 21 wherein said removable mouthpiece cover is shaped such that when the removable mouthpiece cover is engaged with the housing, the removable mouthpiece cover is not in contact with the mouthpiece and reed.

23. The ligature of claim 16 wherein the housing further comprises a slot portion for receiving an engagement portion of a removable mouthpiece cover.

24. The ligature of claim 16 wherein the flexible lace has a first end coupled to the housing, a second end coupled to the spool and a middle portion coupled to the pressure plate.

25. The ligature of claim 16 wherein the pressure plate further comprises an abrasion prevention guide configured to separate the flexible lace.

26. The ligature of claim 16 wherein the pressure plate further comprises one or more lace guide channels configured to receive the flexible lace.

27. The ligature of claim 16 wherein the housing further comprises engagements arms configured to releasably cradle the mouthpiece body.

28. The ligature of claim 27 wherein the engagement arms are lined with a vibration dampening material comprising cork, plastic, leather, synthetic leather, silicone, rubber, cotton, fleece or vinyl.

29. The ligature of claim 27 wherein the housing further comprises receiving slots and the engagement arms further comprise engagement ridges, said receiving slots configured to releasably couple with the engagement ridges of the engagement arms.

* * * * *